US011130599B2

(12) United States Patent
Richert

(10) Patent No.: US 11,130,599 B2
(45) Date of Patent: Sep. 28, 2021

(54) DEVICE FOR STACKING AND PACKAGING FOLDED PRODUCTS

(71) Applicant: Herzog + Heymann GmbH & Co. KG, Bielefeld (DE)

(72) Inventor: Witali Richert, Bielefeld (DE)

(73) Assignee: H+H GMBH & CO. KG, Bielefeld (DE)

( * ) Notice: Subject to any disclaimer, the term of this patent is extended or adjusted under 35 U.S.C. 154(b) by 217 days.

(21) Appl. No.: 16/432,585

(22) Filed: Jun. 5, 2019

(65) Prior Publication Data

US 2020/0002037 A1 Jan. 2, 2020

(30) Foreign Application Priority Data

Jul. 2, 2018 (EP) ..... 18181106

(51) Int. Cl.

| | |
|---|---|
| ***B65B 25/14*** | (2006.01) |
| ***B65B 35/40*** | (2006.01) |
| ***B65B 35/50*** | (2006.01) |
| ***B65B 5/06*** | (2006.01) |

(52) U.S. Cl.

CPC ..... *B65B 25/145* (2013.01); *B65B 5/068* (2013.01); *B65B 25/141* (2013.01); *B65B 35/40* (2013.01); *B65B 35/50* (2013.01)

(58) Field of Classification Search

CPC ..... B65B 5/068; B65B 25/141; B65B 25/145; B65B 35/40; B65B 35/50

USPC ..... 53/447, 473, 540, 542, 247, 258, 259, 53/260

See application file for complete search history.

(56) References Cited

U.S. PATENT DOCUMENTS

| | | | | |
|---|---|---|---|---|
| 3,796,428 A * | 3/1974 | O'Shea et al. | B65B 35/50 | 271/210 |
| 3,880,421 A * | 4/1975 | Muller | B65H 43/00 | 271/259 |
| 3,904,077 A * | 9/1975 | Luginbuhl | B65G 47/06 | 221/175 |
| 4,141,193 A * | 2/1979 | Joa | B65B 25/20 | 53/542 |
| 4,617,784 A * | 10/1986 | Golicz et al. | B65B 27/08 | 53/540 |
| 4,707,970 A | 11/1987 | Labombarde | | |
| 4,870,803 A * | 10/1989 | Blumle | B65B 25/141 | 53/447 |

(Continued)

FOREIGN PATENT DOCUMENTS

| | | | | |
|---|---|---|---|---|
| DE | 1461894 A1 * | 3/1969 | ..... | B65B 35/40 |
| DE | 2546594 A1 * | 4/1977 | ..... | B65B 25/141 |

(Continued)

*Primary Examiner* — Stephen F. Gerrity

(74) *Attorney, Agent, or Firm* — Lucas & Mercanti, LLP

(57) ABSTRACT

A device for stacking and packaging folded products includes a conveying device that conveys a stack of folded products, which folded products are arranged in an upright position in a row, in a transport direction to a delivery area above a receptacle on at least one support element, which supports the stack in the delivery area perpendicularly to the transport direction. The stack is released perpendicularly to the transport direction by shifting or pivoting the at least one support element. A pushing device pushes the stack of folded products out of the delivery area perpendicularly to the transport direction and into the receptacle.

7 Claims, 6 Drawing Sheets

(56) References Cited

U.S. PATENT DOCUMENTS

| | | | | |
|---|---|---|---|---|
| 4,879,862 | A | 11/1989 | Nolte | |
| 5,813,196 | A * | 9/1998 | Page et al. | B65B 5/067 53/171 |
| 6,186,208 | B1 * | 2/2001 | McGilvery | B65B 35/50 156/443 |
| 6,425,227 | B1 * | 7/2002 | Salm et al. | B65B 25/141 53/447 |
| 6,508,352 | B1 * | 1/2003 | Enenkel et al. | B07C 3/008 53/542 |
| 7,021,035 | B2 * | 4/2006 | Muri et al. | B65H 33/02 53/447 |

FOREIGN PATENT DOCUMENTS

| | | | | |
|---|---|---|---|---|
| DE | 29802261 | U1 * | 4/1998 | B65B 25/141 |
| EP | 0154093 | A2 | 9/1985 | |
| EP | 0271042 | A2 | 6/1988 | |
| EP | 0659669 | A1 * | 4/1998 | B65B 25/141 |
| EP | 1787910 | A1 | 5/2007 | |
| GB | 2050989 | A | 1/1981 | |
| WO | 9520523 | A1 | 8/1995 | |

* cited by examiner

DEVICE FOR STACKING AND PACKAGING FOLDED PRODUCTS

CROSS-REFERENCE TO RELATED APPLICATIONS

The present application claims priority of EP 18 181 106.8, filed Jul. 2, 2018, the priority of this application is hereby claimed and these applications are incorporated herein by reference.

FIELD OF THE INVENTION

The present invention relates to a method and a device for stacking and packaging folded products, especially patient information leaflets such as inserts or outserts for pharmaceutical products.

Many products, especially pharmaceutical products, are accompanied by folded products in the form of patient information leaflets, which contain information about the pharmaceutical product and its use. Such folded products are either laid loosely along with the packaged pharmaceutical product in an outer packaging or attached directly to the container of the pharmaceutical product. The folded products are usually folded multiple times by a folding machine and, if required, attached by means of an adhesive. Semi-finished or finished folded products are packed in the form of stacks in receptacles such as trays or boxes. These receptacles filled with folded products are then delivered to the manufacturer of the pharmaceutical products so that they can be enclosed with the pharmaceutical products. Existing methods and devices for stacking and packaging folded products either comprise the manual stacking and manual packaging of the folded products, which are obviously time-consuming and labor-intensive, or are limited with respect to the degree of automation of the packaging process and to the format size of the folded products.

SUMMARY OF THE INVENTION

It is an object of the present invention to provide a method for stacking and packaging folded products which is optimized with respect to time and degree of automation and also to provide a device for executing a method of this type.

According to an aspect of the invention, the method for stacking and packaging folded products comprises the steps of:

forming a stack of folded products, which are arranged in an upright position, one behind the other in a row extending in a transport direction;

arranging the stack of folded products in a delivery area above a receptacle on at least one support element, which supports the stack in the delivery area perpendicularly to the transport direction;

releasing the stack perpendicularly to the transport direction by shifting or pivoting the at least one support element; and pushing the stack of folded products perpendicularly to the transport direction from the delivery area into the receptacle by means of a pushing device.

In this way, a method for stacking and packaging folded products is created in which, immediately after the folded products have been folded, the folded products are automatically stacked and packaged by devices downstream from the folding machine. No manual interventions are required. The time and labor involved in stacking and packaging the folded products and the associated costs can thus be reduced, and the susceptibility of the process to error is decreased as well.

Further, the stack of folded products is supported until it is pushed perpendicularly into the receptacle, and any unwanted shifting of the folded products is prevented. The stack is released perpendicularly to the transport direction only at the time when the folded products are to be pushed into the receptacle.

The receptacle is preferably a tray, a package, or some other receiving means for stacks of folded products especially adapted to the place-saving storage of the folded products and their damage-free transport.

In a first embodiment, forming of the stack comprises the step of arranging a plurality of folded products in an upright position in a stacking area, and arranging the stack in the delivery area comprises the step of conveying the formed stack to the delivery area along a transport path extending in the transport direction as soon as the number of folded products in the formed stack of folded products has reached a predetermined number. The entire stack is thus formed in the stacking area, and the only step required after that is to push the entire stack to the delivery area.

In an alternative embodiment, the forming of the stack comprises the steps of:

arranging a plurality of folded products in an upright position in a stacking area to obtain a partial stack;

pushing the partial stack in the transport direction to a collecting area; and repeating these steps until a stack with a predetermined number of folded products has been formed in the collecting area.

In addition, arranging the stack in the delivery area in this embodiment comprises the step of conveying the stack formed in the collecting area to the delivery area along a transport path extending in the transport direction.

Partial stacks are easier to handle than a whole stack. The throughput is also increased as a result, because, while the stack is being pushed out of the collecting area, the next partial stack can already be in the process of formation in the stacking area without the need to interrupt production.

In an alternative embodiment, forming the stack and arranging the stack in the delivery area comprise the steps of:

arranging a plurality of folded products in an upright position in a stacking area to obtain a partial stack;

pushing the partial stack in the transport direction to a collecting area, which is arranged in the delivery area; and repeating these steps until a stack with a predetermined number of folded products has been formed in the collecting area and thus simultaneously also in the delivery area. The partial stacks are easier to handle in the stacking area than a whole stack. In addition, the throughput is increased as a result, because, while the last partial stack is being pushed into the delivery area, the next partial stack can already be in the process of formation in the stacking area without the need to interrupt production.

After they have been folded, folded products such as outserts in particular usually have a substantially rectangular block-like shape, wherein the edges of the rectangular block, at which the creases of the folded product are located, are more-or-less rounded. The length and width of a substantially rectangular block-shaped folded product are usually greater than its thickness. The length and width thus define two base surfaces of the folded product, which are considerably larger than the other side surfaces. To form space-saving stacks of folded products, it is desirable for the base surfaces of the folded products to rest against each other, so that the size of a stack in the lengthwise direction can be minimized. The base surfaces of the folded products in this case are substantially perpendicular to a support surface, on which the folded products are arranged; and the base surfaces form the front side and rear sides of the folded products relative to the transport direction. Folded products arranged in this way are said to be in an upright position. The stacks of folded products are preferably formed on a substantially horizontal support surface. The base surfaces then extend in a substantially vertical plane.

The method therefore preferably comprises the deflection of the folded products by means of a feed device, so that each folded product enters into the stacking device from above. Folded products which are being transported in a horizontal position are thus easily arranged in an upright position in which they are also stacked one behind the other. The base surfaces of the multiple, successive folded products lie adjacent to each other in the stack. There is no need for any additional devices to set the folded products upright.

It is especially preferred that arranging a plurality of the folded products in the stacking area and conveying the partial stack or stack of folded products to a delivery area occur between two guide devices, which guide and support the folded products along the transport path. For this purpose, the guide devices are arranged opposite each other, on either side of the transport path, and parallel to the transport direction. The guide devices prevent the folded products from shifting laterally or tipping over relative to each other as they are being stacked and as they are being conveyed to the delivery area.

When the stack is being pushed into the receptacle, the stack is preferably bounded on its front and rear sides by two boundary elements, which preferably hold the stack between them and which preferably move along with the stack in the direction toward the receptacle. In this way, the stack can be put under light compression and is positively held on two sides during the pushing process. This facilitates the introduction of the stack into the receptacle.

According to another aspect of the invention, the device for stacking and packaging folded products comprises:

a feed device for feeding individual folded products in succession into a stacking area;

at least one conveying device for conveying a stack or partial stack formed of the folded products, which are in an upright position, in a transport direction to a delivery area;

a receptacle, which is arranged underneath the delivery area; and a pushing device for pushing the stack of folded products arranged in the delivery area out of the delivery area in a direction perpendicular to the transport direction and into the receptacle.

The stack is supported in the delivery area by at least one support element, which can pivot or move in linear fashion. In this way, the stack of folded products can remain supported until it is transferred, and it is released in the pushing direction only for the purpose of transferring it.

In this way, a device is provided in which the folded products are stacked and packaged automatically by appropriate devices. No manual interventions are required. Not only can the time and labor required to stack and package the folded products and the associated costs be reduced, but the vulnerability of the process to error can also be decreased. Increasingly strict quality requirements on the packaging process can thus be fulfilled.

The pushing device preferably comprises a plunger, which rests against a narrow side of the folded products facing away from the receptacle. The plunger preferably extends in the transport direction along an entire side surface of the stack, so that it acts simultaneously on all of the folded products of a stack and can push them all together into the receptacle without damaging the folded products, without shifting them relative to each other, and without interfering with any of the other components of the device.

It is especially preferred that the device also comprises at least two guide devices, which are set up opposite each other, between which the stacking area is formed, and which are set up to accept and support between them the folded products supplied by the feed device. The guide devices are arranged on either side of the transport path and parallel to the transport direction. In an especially preferred embodiment, the at least two guide devices extend from the stacking area to the delivery area along the transport path, so that they give lateral support to the partial stack or stack of folded products along the entire route to the delivery area.

In another preferred embodiment, the distance between two opposing guide devices is adjustable in a direction transverse to the transport direction. As a result, the distance between the guide devices can be adapted to folded products of different formats.

Each guide device preferably comprises a brush on a side of the guide device facing the stacking area. The brushes comprise bristles, which extend from the guide devices into the transport path. When a folded product arrives between the guide devices, it deforms the bristles, which therefore exert a restoring force on the folded product. A clamping action is thus exerted on the folded product by this restoring force of the bristles, as a result of which the folded product is held in its upright position, while at the same time it still remains possible to push the folded product in the transport direction. The stiffness of the bristles can be determined in such a way that the bristles make it possible to support the folded product reliably and simultaneously to push the folded products easily and without damage.

In a preferred embodiment, the device also comprises a first and a second boundary element, wherein the first boundary element is arranged upstream, relative to the transport direction, of the delivery area, and the second boundary element is arranged downstream, relative to the transport direction, of the delivery area; and the first and second boundary elements form the boundaries of the delivery area in the transport direction on both sides at least while the stack is being pushed. As a result, the stack of folded products also remains supported on both sides in the transport direction, so that, in particular, the stack retains its dimensions as it is being pushed into the receptacle and also has a defined length, i.e., the length which the stack must have to be accepted by the receptacle. Above all, the stack of folded products, which have a certain tendency to resume their original shape after the folding process, can be compressed in the transport direction by the first and second boundary elements in order to make possible a reliable insertion of the stack of folded products into the receptacle without the danger that the frontmost and rearmost folded products of the stack could collide with the edges of the receptacle.

Finally, the first and second boundary elements each comprise an opening or recess, and, at least while the stack is being pushed, a plunger of the pushing device extends in the transport direction from the first boundary element to the second boundary element and into the openings or recesses in the first and second boundary elements. This guarantees that the plunger will be able to act on each folded product of the stack of folded products without the plunger interfering with the first and second boundary elements or the boundary elements interfering with the plunger.

DETAILED DESCRIPTION OF SPECIFIC EMBODIMENTS

Figure 1:
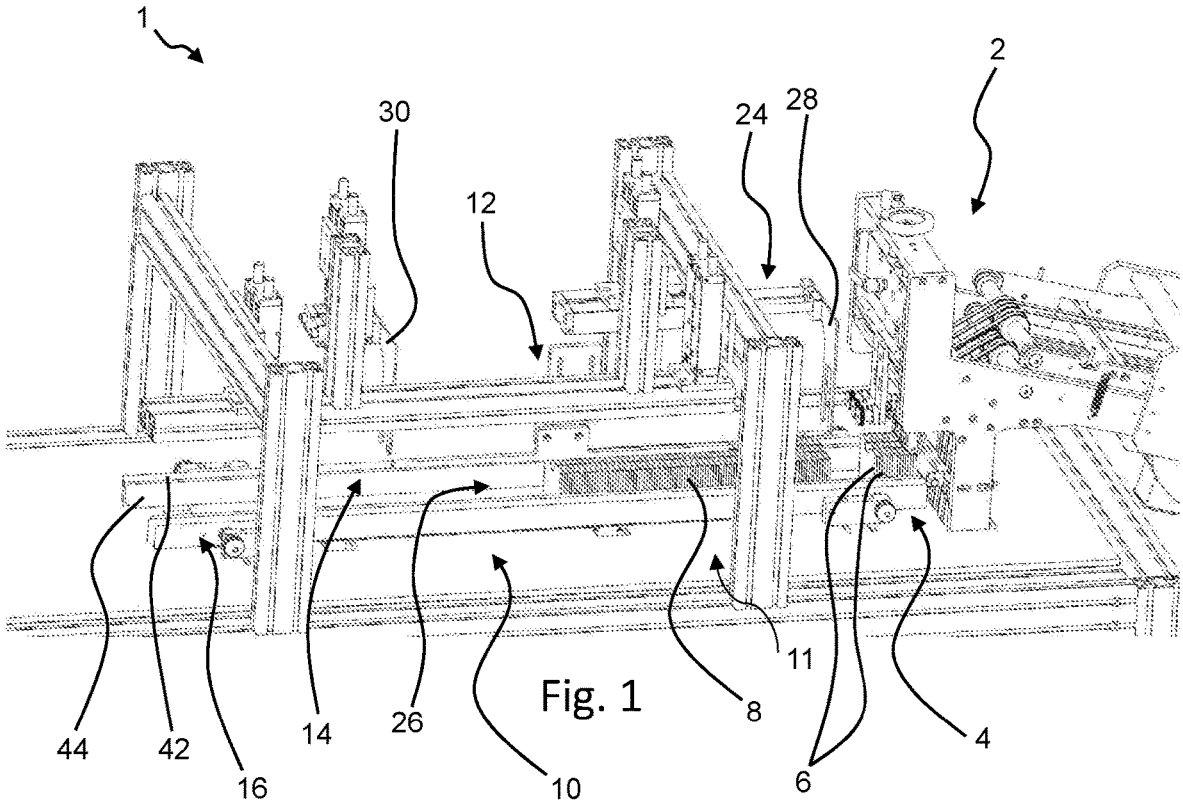
FIG. 1 is an isometric view of a device according to the invention for stacking and packaging folded products.

FIG. 1 shows an embodiment of a device 1 according to the invention for stacking and packaging folded products, especially outserts, especially preferably outserts held closed by glue or closed by means of an adhesive tab. The device 1 comprises a feed device 2 for feeding folded products to a stacking area 4. The feed device 2 is arranged after, preferably immediately after, a folding device (not shown) for folding folded products 6 or forms the outlet of the folding device. In the stacking area 4, a stack 7 of folded products 6 is formed from the individual folded products 6. The stack 7 of folded products 6, which forms a partial stack of a final, complete stack 8, is then conveyed along a transport path from the stacking area 4 to a collecting area 11, in which the partial stacks 7 are assembled to form the stack 8. From there, the stack 8 is conveyed to a delivery area 10. From the delivery area 10, the stack 8 is pushed by means of a pushing device 12 into a receptacle 36 (see FIGS. 7 and 8).

At least in the stacking area 4, a first guide device 14 and a second guide device 16 are arranged opposite each other in a first direction, so that they form the stacking area 4 between them. The guide devices 14, 16 accommodate between them the folded products 6 which have been supplied to them by the feed device 2. The guide devices 14, 16 preferably extend all the way to the delivery area 10 to guide and support the folded products 6 along the transport path.

Figure 2:
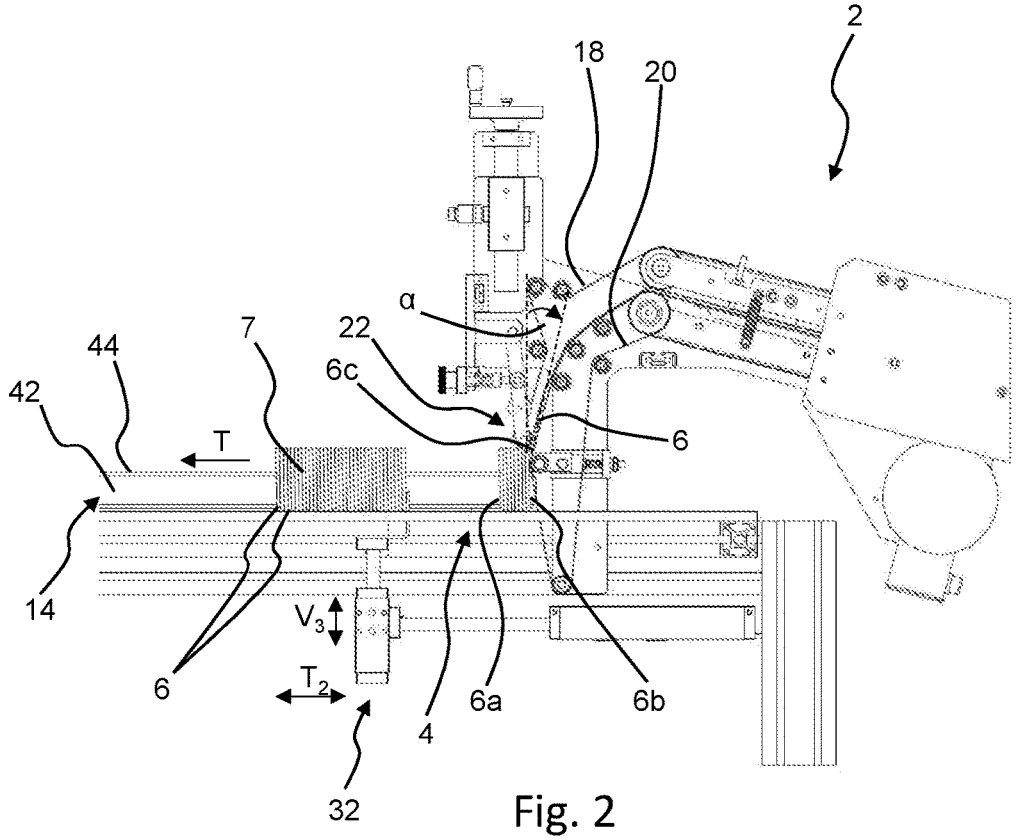
FIG. 2 is a cross-sectional view of a part of the device according to FIG. 1.
Figure 3:
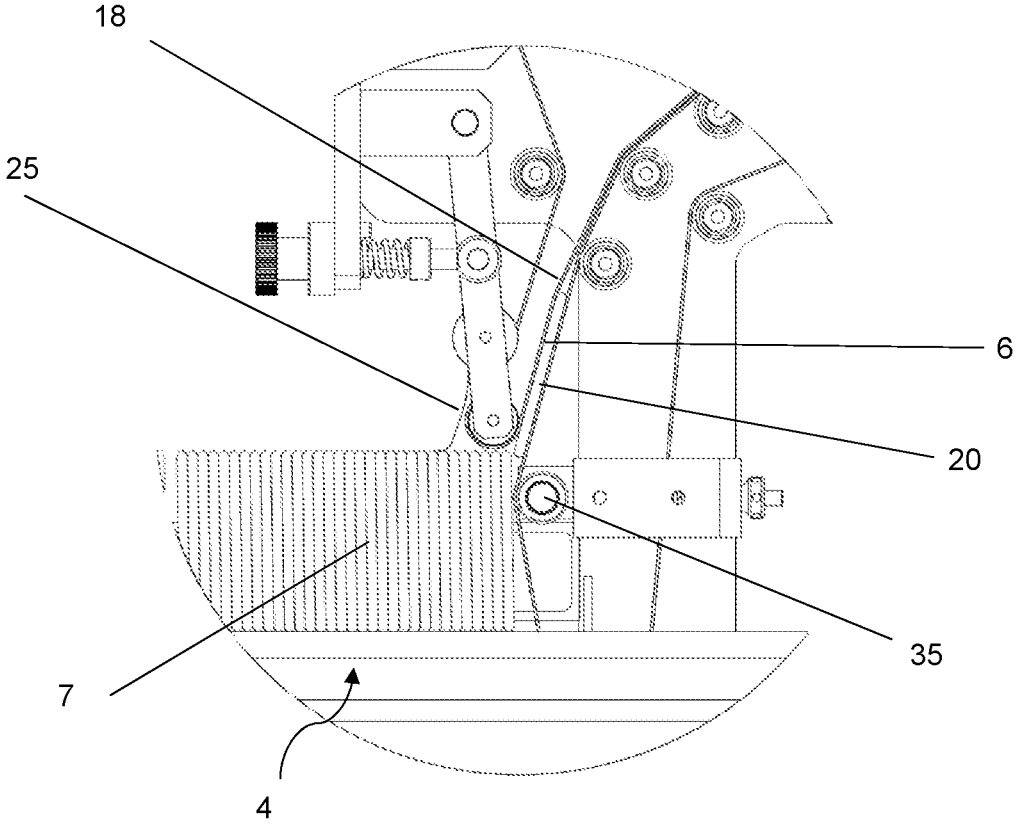
FIGS. 3 and 4 are cross-sectional views of enlarged sections of the stacking area of the device according to FIG. 1.
Figure 4:
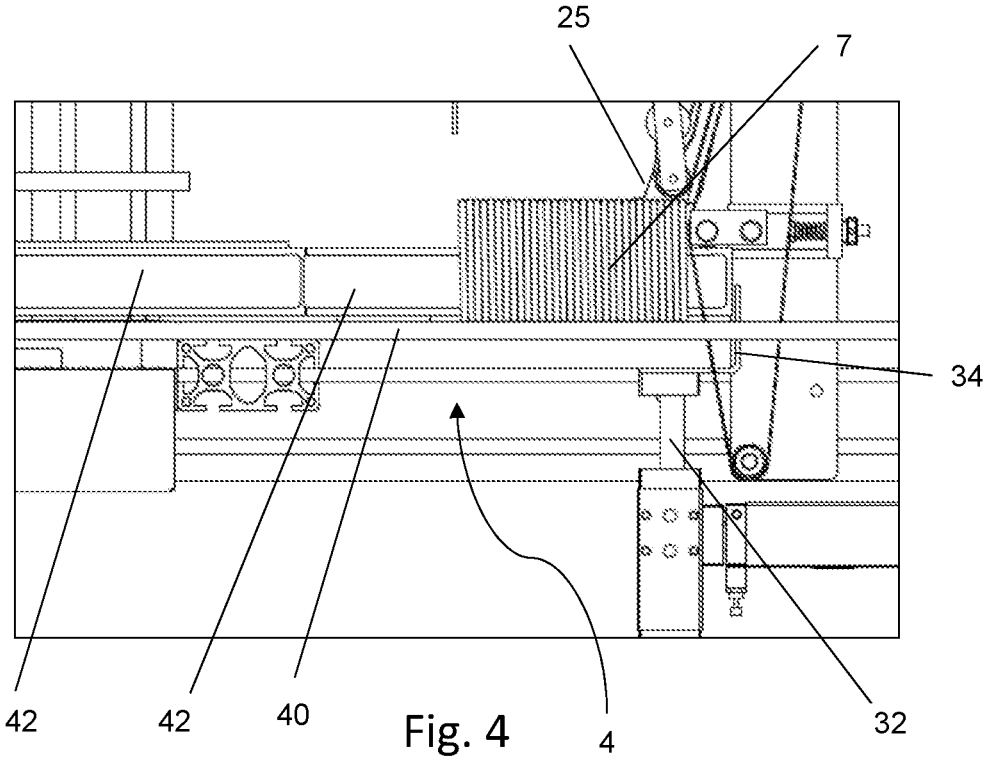
Figure 5:
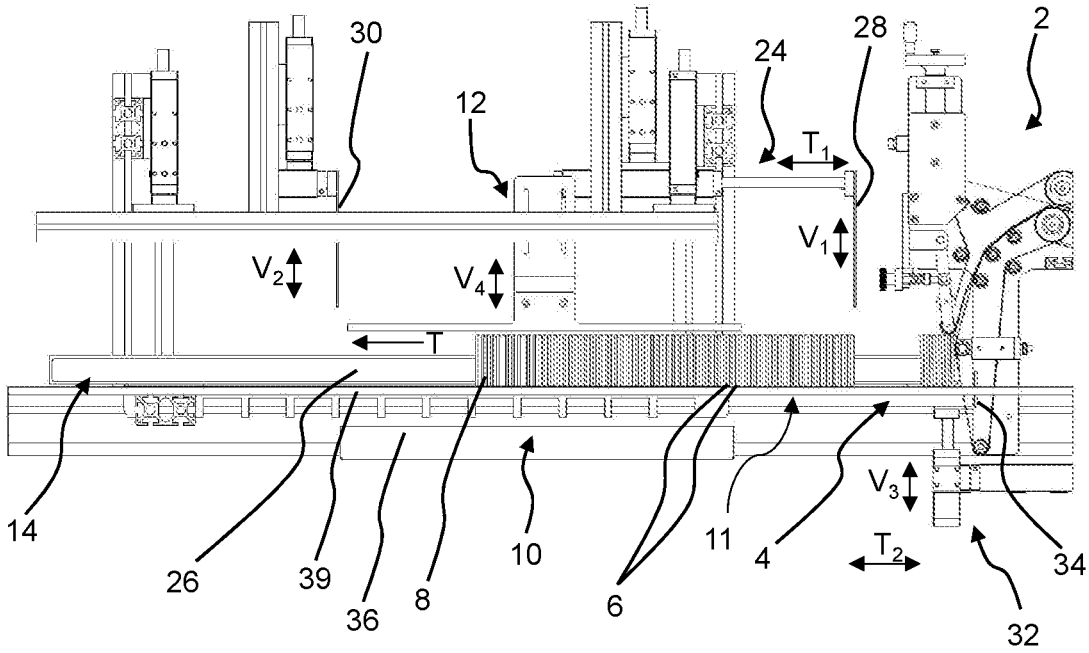
FIGS. 5-8 show a part of the device according to FIG. 1 at different times during the stacking and packaging of folded products.
Figure 6:
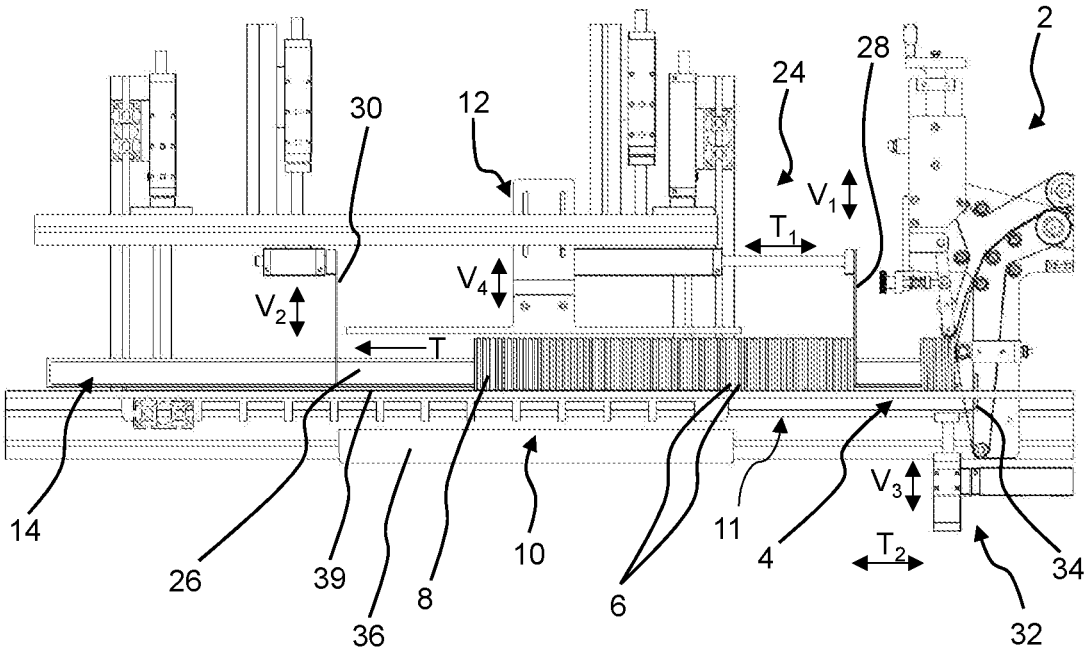

FIGS. 2-4 are cross-sectional views of parts of the device 1 at the outlet 22 of the feed device 2. The stacking area 4 is located at the outlet 22 of the feed device 2. The feed device 2 guides individual folded products 6 in succession into the stacking area 4. In the illustrated embodiment, the feed device 2 comprises for this purpose a first conveyor belt 18 and a second conveyor belt 20. The first and second conveyor belts 18, 20 are arranged so that certain sections of them are adjacent to each other, so that a folded product 6 can be accommodated horizontally between a section of the first conveyor belt 18 and a section of the second conveyor belt 20 and thus conveyed.

A folded product 6 emerges from the feed device 2 at the outlet 22. In the present case, the folded product 6 emerges at the outlet 22 through the gap between the first and second conveyor belts 18, 20. It is preferred that the feed device 2 deflect the folded products 6 in such a way that the folded products 6 are supplied to the stacking area 4 from above. For this purpose, the first and second conveyor belts 18, 20 preferably describe a curve, which tends increasingly downward in the conveying direction of the folded products 6 in the feed device 2.

In the stacking area 4, a leading folded product 6 is first received in an upright position between the first and second guide devices 14, 16. A retaining element 25, here in the form of a spring plate, can also be provided to support the top of the stack 7 to be formed and to prevent the folded products 6 from tipping over toward the front. In the rear area of the stack 7, a pressing roller 35 can provide a counterpressure.

In the upright position of a folded product 6, a base surface of the folded product facing in a transport direction T forms the front side 6*a*, and a base surface of the folded product facing in the direction opposite the transport direction T forms the rear side 6*b*. So that the device can be adapted to folded products of different formats, the first and second guide devices 14, 16 can be moved in the first direction transversely to the transport direction T to adjust the distance between the guide devices 14, 16 in the first direction. The transport direction T and the first direction are preferably substantially horizontal.

Feeding a trailing folded product 6 into the stacking area 4 and introducing this trailing folded product 6 between the first and second guide devices 14, 16 causes the leading folded product 6 to be pushed in the transport direction T between the guide devices 14, 16. As a result of the repeated feed of a folded product 6 into the stacking area 4, of the introduction of the folded product 6 between the guide devices 14, 16, and of the pushing of the at least one leading folded product 6 in the transport direction T associated with each such introduction, a stack 7 of folded products 6 is formed in the stacking area 4. Overall, a plurality of folded products 6 becomes arranged in an upright position in the stacking area, one behind the other in a row in the transport direction T, and the stack 7 of folded products 6 is thus formed. The folded products 6 are supported by the guide devices 14, 16 as the folded products 6 are being introduced between the guide devices 14, 16 and as the folded products 6 are being pushed in the transport direction T.

To guarantee that the folded products 6 are fed reliably into the stacking area 4, it is preferred that a trailing folded product 6 enters the stacking area 4 at an angle to the at least one leading folded product 6 and thus pushes the at least one leading folded product 6 in the transport direction T. For this purpose, the first and second conveyor belts 18, 20 at the outlet 22 of the feed device 2 are oriented at a slight angle to the folded products 6 standing upright in the stacking area 4. As a result, the leading edge 6*c* of a trailing folded product 6 strikes a rear side 6*b* of a leading folded product 6, i.e., the side facing the trailing folded product 6. An acute angle $\alpha$ between the rear side 6*b* of the leading folded product 6 and the front side 6*a* of the trailing folded product 6 is preferably formed at the time when the trailing folded product 6 strikes the leading folded product 6 at the outlet 22 of the feed device 2. Thus the trailing folded product 6 reliably arranges itself behind the at least one leading folded product 6 without becoming jammed against it. In addition, the at least one leading folded product 6 is pushed in the transport direction T as soon as the trailing folded product 6 strikes its rear side 6*b*.

It is obvious that the skilled person will be familiar with alternative feed devices 2 to transport folded products 6 to a stacking area 4.

As shown in FIGS. 5-8, the device 1 further comprises a feed unit 32 to convey partial stacks 7 formed in the stacking area 4 to a collecting area 11, which will be described in greater detail further below. In addition, the device 1 comprises a conveying device 24 for conveying a finished stack 8 of folded products 6 from the collecting area 11 to the delivery area 10. The stack 8 is complete as soon as it comprises a predetermined number of folded products 6. The finished stack 8 consists of a plurality of partial stacks 7. In the feed unit 32 and in the conveying device 24, the folded products 6 are preferably conveyed along a transport path 26 oriented in the transport direction T.

The conveying device 24 can be moved in a direction T1 parallel to the transport direction T. In the embodiment shown here, the conveying device 24 is also movable in a direction V1 transverse to the transport direction T. The direction V1 is preferably oriented vertically. The conveying device 24 comprises a first boundary element 28, which is movable in and out of the transport path 26 in direction V1.

The first boundary element 28 serves to grip the last folded product 6 of a stack 8 and preferably lies flat against the rear side 6*b* of this folded product. A second boundary element 30 can be provided, which is movable in a direction V2 transverse to the transport direction T. The direction V2 is preferably vertical and parallel to the direction V1.

Relative to the transport direction T, the second boundary element 30 forms the downstream boundary of the delivery area 10 as the conveying device 24 conveys the stack 8 into the delivery area 10. Once the stack 8 is arranged in the delivery area 10, the first boundary element 28 forms the upstream boundary, relative to the transport direction, of the delivery area 10, and the stack 8 is thus held between the first and second boundary elements 28, 30.

As can be seen in FIGS. 5-8, the previously mentioned feed unit 32 is movable in a direction T2 parallel to the transport direction T and in a direction V3 transverse to the transport direction T. The direction V3 is preferably parallel to the directions V1 and V2 and oriented vertically. So that the feed unit 32 can be moved back and forth, at least part of it projects through an opening in the support surface 40, on which the stack 7 rests.

The feed unit 32 comprises a pusher 34. The pusher 34 is arranged in the stacking area 4, upstream from the stack of folded products 6 formed in the stacking area 4. The pusher 34 serves to act on the last folded product 6 of a stack 7 and preferably rests flat against the rear side 6*b* of this folded product 6. By moving the feed unit 32 in the transport direction T, the feed unit 32 conveys the stack 7 in the transport direction T along the transport path 26, as can be seen in FIG. 2, all the way to the collecting area 11, where the complete stack 8 is formed.

Figure 7:
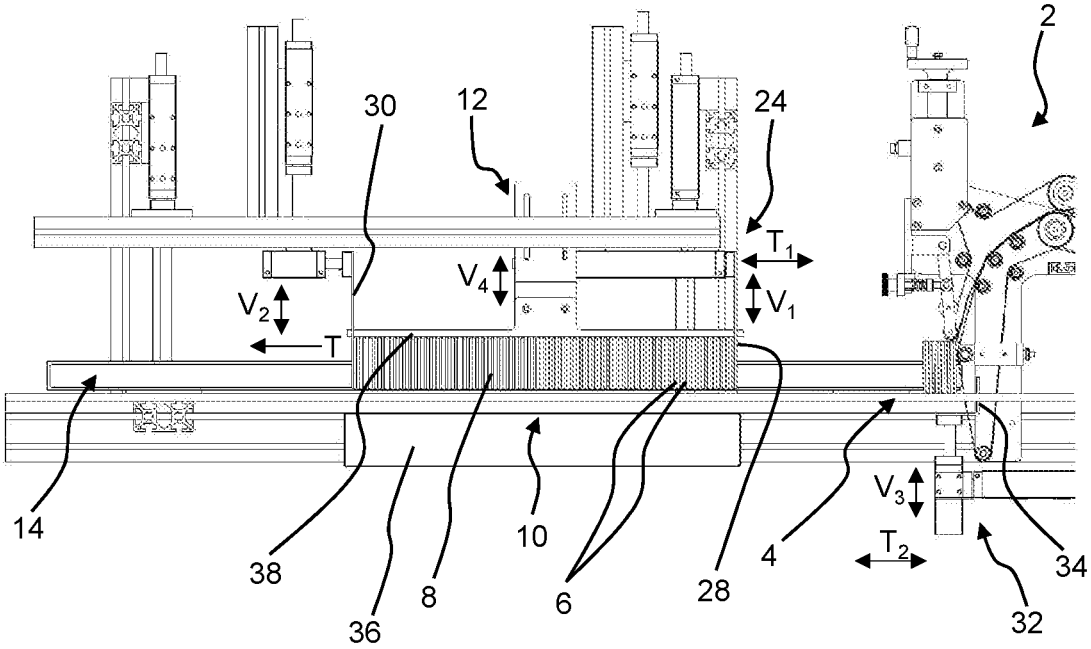

A stack 7 is a partial stack and comprises a predetermined number of folded products 6 which is smaller than the predetermined number of folded products 6 of a finished stack 8 in the collecting area 11. The feed unit 32 conveys partial stacks 7 until they are in the area where the first boundary element 28 can act on them. The feed unit 32 repeats this as often as is necessary until a plurality of partial stacks 7 forms a complete stack 8. The first boundary element 28 is then moved into the transport path 26 (FIG. 6), and the conveying device 24 conveys the stack 8 onward into the delivery area 10 (FIG. 7).

The feed unit 32 moves back into its starting position upstream from the stacking area 4. If a new stack 7 of folded products 6 has already been formed in the stacking area 4 before the feed unit 32 has returned to its starting position, the feed unit 32 must be moved in direction V3 out of the transport path 26 and then moved back into its starting position a certain distance away from the stacking area 4.

Alternatively, the conveying device 24 could accept the partial stacks 7 from the feed unit 32 and push them into the collecting area 11. In this case, the first boundary element 28 cycles around an endless, repeating path for each partial stack 7.

In contrast to the embodiment illustrated here, it is also possible to omit the feed unit 32. In this case, a complete stack 8 is formed in the stacking area 4, and the conveying device 24 conveys the complete stack 8 of folded products 6 from the stacking area 4 directly to the delivery area 10. The conveying device 24 can then be moved in the direction opposite the transport direction T to such an extent that the first boundary element 28 is positioned behind (relative to the transport direction T) the last folded product 6 of the complete stack 8 of folded products 6 in the stacking area 4. The first boundary element 28 is then moved into the stacking area 4, so that the first boundary element 28 rests against the rear side 6*b* of the last folded product 6 of the stack 8. Moving the first boundary element 28 in the transport direction T has the effect of pushing the stack 8 of folded products 6 in the transport direction T along the transport path 26 until it reaches the delivery area 10.

In another embodiment, the feed unit 32 can also convey the partial stacks 7 to the delivery area 10 and form the complete stack 6 there. In this case, the conveying device 24 can be omitted. The boundary element 28, however, must continue to be movable in the vertical direction out of the transport path 26 to allow the partial stack 7 to pass through.

When the stack 8 is being formed of the partial stacks 7, it is preferred that each partial stack 7 be conveyed to the same point in the collecting area 11, where it will come in contact with the last of the other partial stacks 7 which may already be present and thus push these already-present partial stacks 7 further along in the transport direction T.

As can be seen in FIG. 7, the complete stack 8 of folded products 6 in the delivery area 10 is arranged above a receptacle 36. The stack 8 is preferably held between the first and second boundary elements 28, 30, which form the two boundaries of the stack 8 in the transport direction. The first and second boundary elements 28, 30 compress the stack 8 in the transport direction T in such a way that its length in the transport direction T is somewhat smaller than the inside dimension of the receptacle 36 parallel to the transport direction T. For this purpose, the boundary elements 28, 30 are preferably movable, at least slightly, in and/or opposite the transport direction T.

The receptacle 36 is preferably a tray, a package in the form of a box, or some other type of means for receiving stacks 8 of folded products 6. The receptacle 36 serves to accept a complete stack 8 of upright folded 6 simultaneously and to pack them up for transport.

The receptacle 36 is preferably configured with enough stiffness to ensure that the folded products 6 are protected from external influences such as impacts during their transport. In addition, the receptacle 36 preferably has a rectangular block-like shape, so that the stacks can be stored in a space-saving manner and also transported in a space-saving manner. The length of the receptacle 36 parallel to the transport direction T is preferably in the range of 300-1,200 mm. The width of the receptacle 36 transversely to the transport direction T is preferably in the range of 25-220 mm. In any case, the size of the receptacle 36 is to be adapted to the dimensions of the folded products 6 to be packaged.

The base surfaces of the folded products 6, i.e., their front and rear sides 6*a*, 6*b*, preferably have minimum dimensions of 29 mm×29 mm and maximum dimensions of 220×105 mm. The thickness of the folded products 6 is preferably in the range of 1-20 mm. It is obvious that the dimensions of the folded products 6 and of the receptacle 36 can be adapted as desired to the existing requirements.

The receptacle 36 is removably supported in the device 1. The support (not shown) is configured in such a way that the receptacle 36 is always in a defined position relative to the delivery area 10. A receptacle 36 filled with a stack 8 of folded products 6 can be removed manually, and a new, empty receptacle 36 can be inserted manually also. The removal and insertion of a receptacle 36 can also be automated, however.

As can be derived from FIG. 7, the device 1 also comprises a pushing device 12 for pushing a stack 8 of folded products 6 transversely to the transport direction T into the receptacle 36. The pushing device 12 is for this purpose movable in a direction V4 transverse to the transport direction T.

In the embodiment shown here, the pushing device 12 is a certain distance away from the delivery area 10 and comprises a plunger 38. The plunger 38 extends in the transport direction T, preferably along the entire length of the stack 8 of folded products 6, after the stack 8 has been arranged in the delivery area 10. It is also conceivable, however, that the first and second boundary elements 28, 30 could compress the stack 8 so strongly that a pushing of the stack 8 transversely to the transport direction T is possible even if the plunger 38 does not extend along the entire length of the stack 8. It is also conceivable that the first and second boundary elements 28, 30 could extend along a certain portion of the stack 8 in the transport direction T and thus cooperate with the plunger 38 to form a common contact surface for the stack 8. Finally, it is also possible that the pushing device 12 could be formed only by the first and second boundary elements 28, 30.

Figure 8:
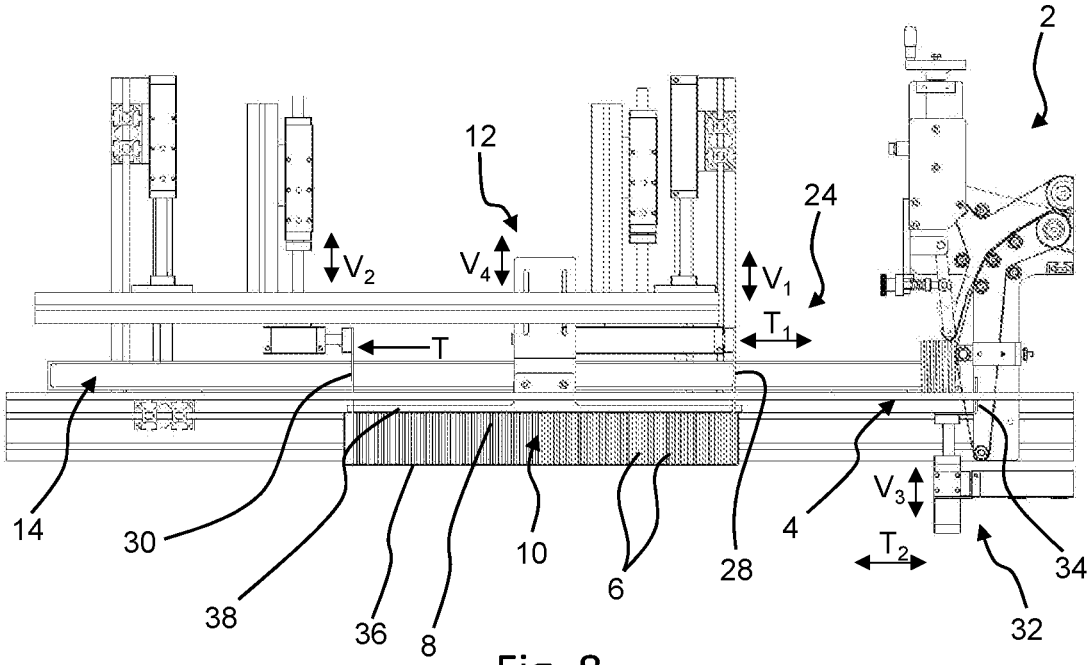

The pushing device 12 is preferably moved in direction V4 until it rests against the stack 8 of folding products 6 only after the stack 8 has been conveyed into the delivery area 10. The direction V4 is oriented vertically, and the stack is located in the delivery area 10 underneath the plunger 38. The receptacle 36 is arranged in turn underneath the delivery area 10 and the stack 8. As shown in FIG. 8, finally, the pushing device 12 has pushed the stack 8 of folded products 6 transversely to the transport direction T from the delivery area 10 into the receptacle 36. For this purpose, the pushing device 12 is moved transversely to the transport direction T until the stack 8, a narrow side of the upright folded products 6 being in the lead, is completely accommodated in the receptacle 36. A stack 8 fills the entire receptacle 36. It is preferable for the first and second boundary elements 28, 30 to move transversely to the transport direction T simultaneously. As a result, it is achieved that the stack 8 retains its original length parallel to the transport direction T while it is being pushed by the pushing device 12. The edges of the receptacle 36 are thus prevented from interfering with the folded products 6 of the stack 8 as they are being introduced into the receptacle 36.

Once the stack 8 of folded products 6 is completely accommodated in the receptacle 36, the first and second boundary elements 28, 30 and the plunger 38 can be moved back in the opposite direction. It is preferable for the first and second boundary elements 28, 30 to be moved out of the receptacle 36 first, so that the plunger 38 can keep the stack 8 in position meanwhile. This prevents the first and second boundary elements 28, 30 from pulling individual folded products 6 out of the receptacle 36 when these elements are retracted. As soon as the first and second boundary elements 28, 30 have been removed from the receptacle 36, the plunger 38 can also be retracted. The receptacle 36, which is now holding the folded products 6, is removed. A new, empty receptacle 36 must then be arranged at an appropriate distance from the delivery area 10.

A support surface 40 supports the folded products 6 from below. The support surface 40 preferably extends from the stacking area 4 to the delivery area 10. In the delivery area 10, the support surface 40 is formed by two support elements 39, which release the stack 8 before the stack 8 is pushed into the receptacle 36 perpendicularly to the transport direction T (see FIGS. 9 and 10). These support elements 39 are preferably configured as L-angle sections, one leg of which projects downward. The support elements 39 can be pushed laterally from the delivery area 10 toward the outside to form an opening in the support surface 40. The pushing device 12 can then push the stack 8 of folded products 6 perpendicularly to the transport direction T into the receptacle 36. As the lower legs of the support elements 39 are being laterally displaced, they also push the sides of the receptacle 36 laterally apart.

Figure 9:
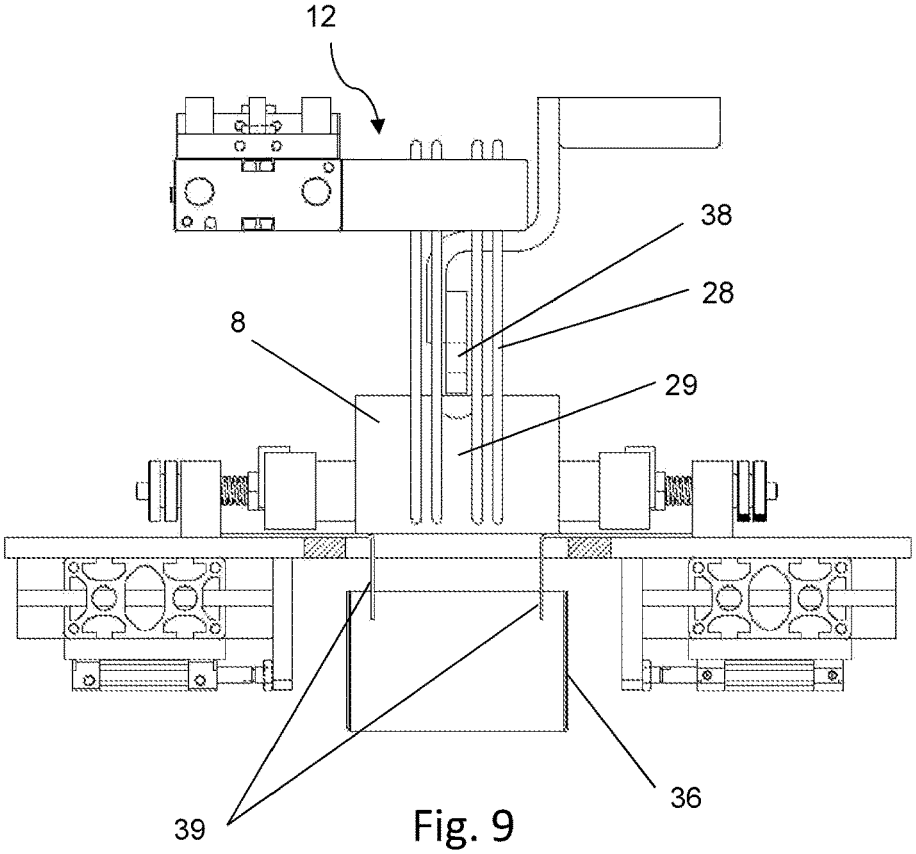
FIGS. 9 and 10 are cross-sectional views of the delivery area of the device of FIG. 1 in two phases of the pushing process.
Figure 10:
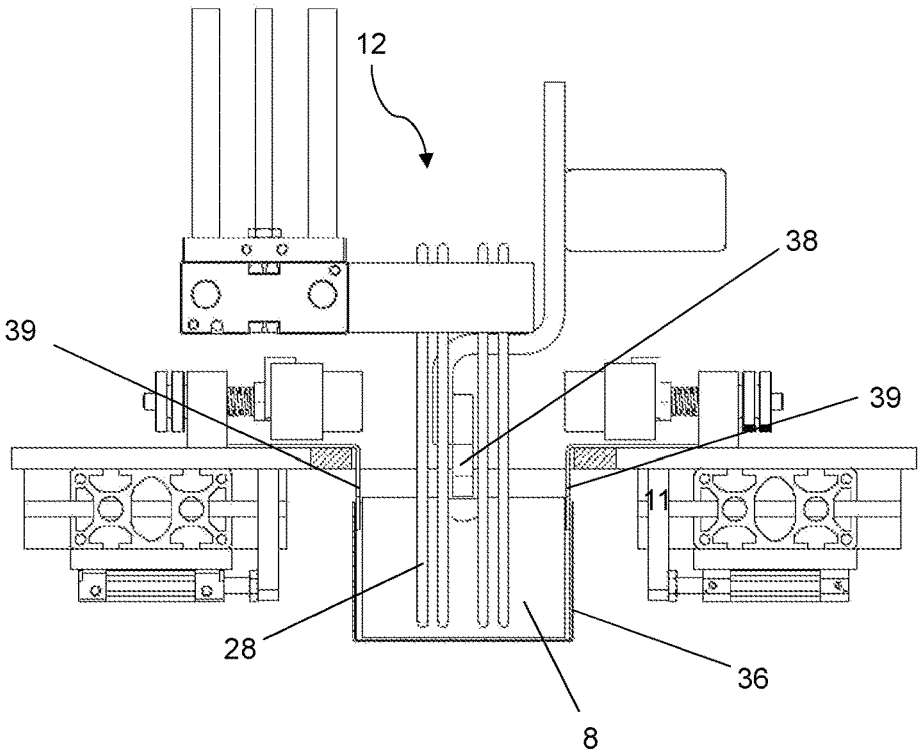

It is also conceivable that only one support element 39 could be provided. It is also possible that the support element or elements 39 could pivot instead of shifting in linear fashion. In a preferred embodiment as can be seen in FIG. 9, the first and second boundary elements 28, 30 each comprise an opening 29 or recess. This opening 29 can be a through-opening, which passes all the way through the associated boundary element 28, 30. The opening 29 can be configured as a recess of any desired contour, completely surrounded by the associated boundary element 28, 30. The opening 29 can also be in the form of a recess in one edge of the associated boundary element 28, 30, so that the boundary element 28, 30, as shown in FIG. 9, comprises several webs, which extend alongside the associated recess. Alternatively, the opening 29 is configured as a depression in a side surface, i.e., the side facing the delivery area 10, of the associated boundary element 28, 30. At least while the stack 8 is being pushed by the pushing device 12, as shown in FIGS. 7 and 8 as well as in FIGS. 9 and 10, the plunger 38 extends in the transport direction T from the first boundary element 28 to the second boundary element 30 and into the associated openings in the first and second boundary elements 28, 30.

In the embodiment illustrated here, the plunger 38 extends in the transport direction T through the first and second boundary elements 28 and 30, as can be seen in FIGS. 7 and 8. This ensures that the pushing device 12, i.e., the plunger 38, acts on all of the folded products 6 of the stack 8, including those which are directly adjacent to the boundary elements 28, 30. If the openings in the boundary elements 28, 30 are configured as recesses proceeding from the edge of the boundary element 28, 30 facing the receptacle 36, the boundary elements 28, 30 can be removed completely from the receptacle 36, while the pushing device 12 remains resting against the stack 8.

As can be derived from the explanations given above, at least the conveying device 24, the pushing unit 32, the pushing device 12, and the first and second boundary elements 28, 30 are movable. For this purpose, each of these components or devices comprises an appropriate drive.

These drives are preferably formed by pneumatic or hydraulic cylinders or by servo motors. Such drives can be integrated especially easily into the overall machine and are easy to control. The individual drives can be coupled together or can be controllable independently of each other. The skilled person will be able to select appropriate drives to meet the existing requirements.

As can be seen in FIGS. 1-10, the guide devices 14, 16 are set up opposite each other, form between them the stacking area 4, and are designed to accommodate and to support the folded products 6 fed to them in succession by the feed device 2 to form a stack 7, 8 of upright folded products 6. The guide devices 14, 16 are preferably arranged such that they are parallel to the transport direction T and are opposite each other in a first direction which is transverse to the transport direction T, wherein one of the guide devices 14, 16 is arranged on each side of the transport path 26 to provide the folded products 6 with lateral guidance along the transport path 26. The two guide devices 14, 16 preferably extend in a straight line from the stacking area 4 to the delivery area 10.

In an especially preferred embodiment, each of the guide devices 14, 16 comprises a brush 42 on the side of the guide device 14, 16 facing the stacking area 4. An embodiment of one of these brushes can be seen in FIGS. 11*a* and 11*b*. Each guide device 14, 16 also comprises at least one support structure 44 (see FIGS. 1 and 2), to which the brushes 42 are connected. The brushes 42 are preferably connected detachably to the support structure 44; they can be screwed to it, for example. In one embodiment, each guide device 14, 16 comprises a plurality of brushes 42, which are arranged in a row, one after the other, parallel to the transport direction T, along the associated guide device 14, 16. As a result, the guide devices 14, 16 can be built in modular fashion and adapted as desired to the given requirements. For example, it is advantageous for the brushes 42 to be stiffer and/or shorter in the stacking area 4 (on the right in FIG. 4) than in the delivery area 10 or in the further course of the guide devices 14, 16 (on the left in FIG. 4).

Figure 11A:
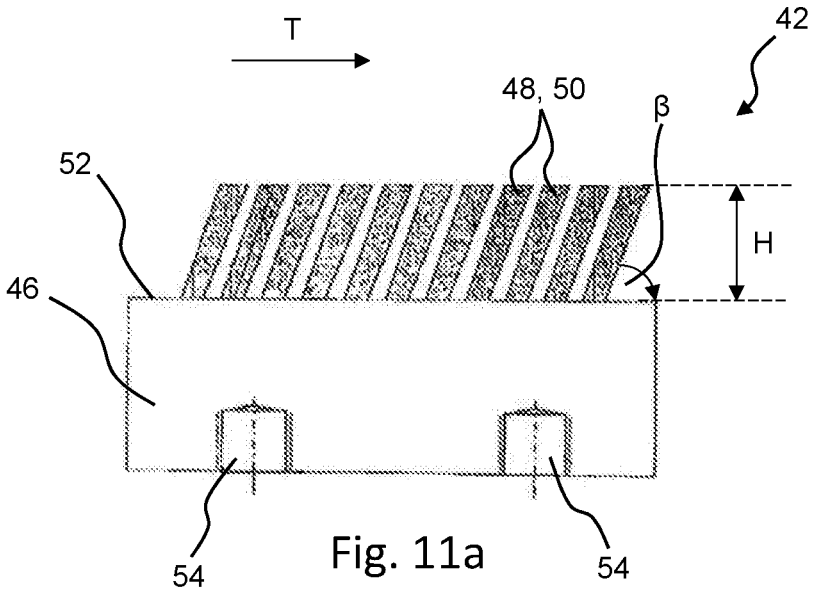
FIG. 11*a* is a side view of an embodiment of a brush of a guide device.
Figure 11B:
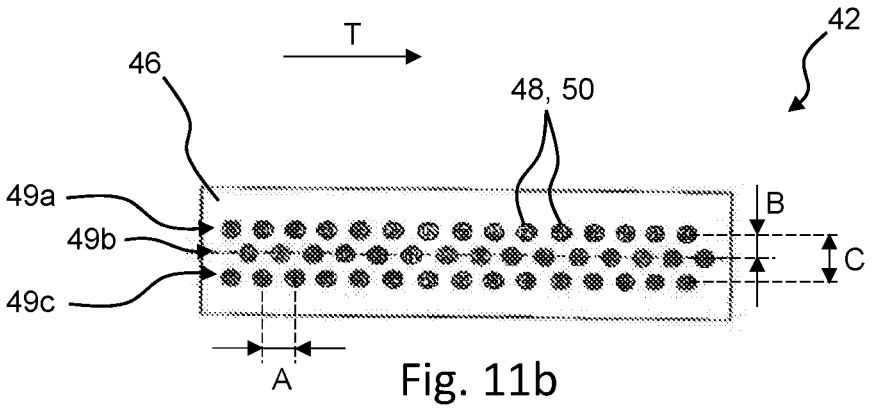
FIG. 11*b* is a top view of the brush according to FIG. 11*a*.

As shown in FIGS. 11*a* and 11*b*, each brush 42 comprises a body 46 and a plurality of bristles 48, connected to the body 46. The bristles are preferably arranged in a plurality of bristle bundles 50. The bristles 48 are preferably arranged in a plurality of rows 49*a*, 49*b*, 49*c*.

The brushes are arranged on the support structures 44 in such a way that the bristles 48 extend into the stacking area 4 or into the transport path 26. The rows 49*a*, 49*b*, 49*c* are then arranged one above the other in a second direction, which is transverse to the transport direction T and transverse to the first direction. The second direction is preferably oriented substantially vertically. The rows 49*a*, 49*b*, 49*c* also extend parallel to the transport direction T. As can be seen in FIG. 11*b*, two adjacent rows 49*a*, 49*b*, 49*c* of bristles 48 are offset from each other in the transport direction T.

When a folded product 6 is arranged between two opposing brushes 42, it elastically deforms the bristles 48 resting against the folded product 6. Because of the intrinsic force of the bristles 48, which tries to return them to their original position, the bristles 48 in this state exert a clamping force on the folded product 6 and support it laterally. Because of the flexibility of the bristles 48, the folded products 6 or the partial stack 7 or the stack 8 of folded products 6 can nevertheless be pushed in the transport direction T, while the clamping effect exerted by the adjacent bristles 48 of the brushes 42 in question continues to act on the folded products 6. The bristles 48 advantageously comprise a stiffness which is sufficient to hold and to support the folded products 6. At the same time, the bristles 48 are flexible enough that they allow the folded products 6 to be pushed in the transport direction T without damage.

So that the folded products 6 of the stack 7, 8 can be pushed more easily in the transport direction T, the bristles 48 are preferably tilted at an angle β in the transport direction relative to the body 46. The angle β is defined between a side surface 52 of the body 46, to which the bristles 48 are connected, and a longitudinal axis of the bristles 48 and is preferably in the range of 45-85°, more preferably in the range of 70-80°. This guarantees that the bristles 48 will bend in a predetermined direction when a folded product 6 is inserted between two opposite brushes 42.

In a preferred embodiment, the bristles 48 are made of horsehair. In particular, bristles 48 of horsehair have a suitable stiffness and are gentle to the folded products 6 as they are being transported along the transport path 26, so that no damage is inflicted on the folded products 6. Alternatively, however, the bristles 48 could also be made of some other natural material, especially animal hairs, or of plastic or wire.

The body 36 of the brushes 42 is preferably made of plastic, e.g., polyvinyl chloride (PVC) or polyamide (PA). The body 46 can then be produced especially easily and cheaply and will be light in weight. Alternatively, the body 46 could also be made of some other material such as wood or metal. The brushes 42 can be connected detachably to the support structure 44, if the body 46 comprises threaded bores 54. The brushes 42 can then be screwed to the support structure 44. It is obvious that the skilled person will be familiar with alternative means for detachably connecting the brushes 42 to the support structure 44, which can be used as desired.

The brush 42 shown in FIGS. 11*a* and 11*b* is an exemplary embodiment, in which the distance A between two adjacent bundles 50 of bristles is in the range of 2-10 mm in the transport direction T, preferably in the range of 4-6 mm. The distance B between two adjacent rows 49*a*, 49*b*, 49*c* of bristles transversely to the transport direction T is also in the range of 2-10 mm, preferably in the range of 4-6 mm. It is also preferred that the brush 42 comprises between three and ten rows 49*a*, 49*b*, 49*c* of bristles 48, even more preferably between five and eight rows 49*a*, 49*b*, 49*c* of bristles 48. The working width C of the brush 42 is defined as the distance between the outermost rows 49*a* and 49*c* of bristles 48 in a direction transverse to the transport direction T and is preferably in the range of 10-50 mm, more preferably 20-30 mm. It is obvious that the working width C is to be adapted to the format of the folded products 6. The fiber height H of the bristles 48 is defined perpendicularly to the side surface 52 of the body 46 and is preferably in the range of 5-50 mm, more preferably of 15-25 mm. Alternative dimensions are conceivable and can be selected by the skilled person in accordance with the requirements existing in the individual case.

The preceding discussion refers to one example, in which one row of folded products 6 forms a partial stack 7 or a stack 8. All of the previously described embodiments, however, can be easily adapted to situations in which, in a direction transverse to the transport direction T, preferably in the first direction, multiple folded products 6 are arranged next to each other. A partial stack 7 or stack 8 will then comprise a plurality of rows of folded products 6, which are arranged next to each other in the direction transverse to the transport direction T and extend in the transport direction T.eb;normal

The invention claimed is:

1. A device for stacking and packaging folded products, comprising:

a feed device for feeding individual folded products in succession into a stacking area;

at least one conveying device for conveying a stack or a partial stack formed from the folded products, which folded products are in an upright position, in the transport direction into a delivery area;

at least one support element for supporting the stack in the delivery area, wherein the at least one support element is pivotable or shiftable in order to release the stack;

a receptacle, which is arranged underneath the at least one support element; and a pushing device for pushing the stack of folded products arranged in the delivery area out of the delivery area perpendicularly to the transport direction into the receptacle;

a first boundary element and a second boundary element, wherein the first boundary element is arranged upstream, relative to the transport direction, of the delivery area, and wherein the second boundary element is arranged downstream, relative to the transport direction, of the delivery area; and wherein, at least while the stack is being pushed into the receptacle, the first boundary element and the second boundary element form the boundaries of the delivery area on both sides relative to the transport direction;

wherein the first boundary element and the second boundary element each have an opening or recess, and wherein, at least while the stack is being pushed into the receptacle, a plunger of the pushing device extends from the first boundary element to the second boundary element and into the openings or recesses in the first boundary element and the second boundary element.

2. The device of claim 1, wherein the pushing device comprises a plunger, which is arranged to rest against a narrow side of the folded products.

3. The device of claim 1, further comprising at least two guide devices, which are opposite each other, which form between them the stacking area, and which are arranged and structured to accommodate and to support between them the folded products.

4. The device of claim 3, wherein the at least two guide devices comprise brushes having a body and bristles, the bristles facing each other and extending into the stacking area from two sides.

5. The device of claim 4, wherein the bristles are inclined in the transport direction in relation to the body by an angle.

6. The device of claim 5, wherein the angle is between 45° and 85°.

7. The device of claim 5, wherein the angle is between 70° and 80°.

* * * * *